US008611782B2

(12) United States Patent
Sato

(10) Patent No.: US 8,611,782 B2
(45) Date of Patent: Dec. 17, 2013

(54) IMAGE FORMING DEVICE AND DEVELOPMENT UNIT ATTACHABLE THERETO

(75) Inventor: Shougo Sato, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 403 days.

(21) Appl. No.: 12/886,192

(22) Filed: Sep. 20, 2010

(65) Prior Publication Data

US 2011/0069995 A1 Mar. 24, 2011

(30) Foreign Application Priority Data

Sep. 18, 2009 (JP) ..... 2009-217421
Sep. 18, 2009 (JP) ..... 2009-217424

(51) Int. Cl.
*G03G 15/00* (2006.01)

(52) U.S. Cl.
USPC ..... 399/110; 399/258; 399/364; 399/297

(58) Field of Classification Search
USPC ..... 399/258, 110, 364
See application file for complete search history.

(56) References Cited

U.S. PATENT DOCUMENTS 6,167,211 A * 12/2000 Oogi et al. ..... 399/53
6,898,382 B2 * 5/2005 Shibaki ..... 399/16
2006/0140673 A1 6/2006 Kamimura et al.
2007/0001370 A1 * 1/2007 Konishi ..... 271/10.11
2007/0189811 A1 8/2007 Sato
2008/0213008 A1 9/2008 Sato
2009/0010662 A1 * 1/2009 Naoi et al. ..... 399/44
2009/0142092 A1 6/2009 Sato
2009/0166944 A1 * 7/2009 Bahrami et al. ..... 270/18

FOREIGN PATENT DOCUMENTS

JP H09-319173 A 12/1997
JP H11-119496 A 4/1999
JP 2001-103217 A 4/2001
JP 2006-184552 A 7/2006
JP 2007-212966 A 8/2007
JP 2008-216450 A 9/2008
JP 2009-047770 A 3/2009
JP 2009-157135 A 7/2009

* cited by examiner

*Primary Examiner* — Walter L Lindsay, Jr.
*Assistant Examiner* — Roy Y Yi
(74) *Attorney, Agent, or Firm* — Baker Botts L.L.P.

(57) ABSTRACT

An image forming device includes an image forming unit that includes a development agent container, a development device that supplies development agent in the development agent container to an electrostatic latent image on a photoconductive body and forms a development agent image on the photoconductive body, a transfer unit transferring, onto a sheet, the development agent image on the photoconductive body, and a fixing unit fixing the development agent image on the sheet, a feed tray disposed under the image forming unit, a pickup unit feeding a sheet placed on the feed tray toward the image forming unit in a U-turn manner, a first conveying path tilted to extend downward obliquely from the pickup unit, and a second conveying path tilted to extend toward the fixing unit obliquely from a continuous section between the first conveying path and the second conveying path.

18 Claims, 6 Drawing Sheets

IMAGE FORMING DEVICE AND DEVELOPMENT UNIT ATTACHABLE THERETO

CROSS-REFERENCE TO RELATED APPLICATION

This application claims priority under 35 U.S.C. §119 from Japanese Patent Applications No. 2009-217421 filed on Sep. 18, 2009 and No. 2009-217424 filed on Sep. 18, 2009. The entire subject matters of the applications are incorporated herein by reference.

BACKGROUND

1. Technical Field

The following description relates to one or more image forming devices and development units attachable thereto that are configured to supply development agent to an electrostatic latent image formed on a photoconductive body.

2. Related Art

An image forming device has been known that includes a feed tray configured such that one or more sheets are stacked therein, which feed tray is disposed to protrude forward from a front panel of a main body of the image forming device.

Further, a development unit attachable to the image forming device has been known, which development unit includes a development section having a development roller configured to hold development agent thereon, and a development agent container that is disposed in a position adjacent to and lower than the development section and configured to accommodate development agent. Further specifically, the development section includes a supply roller that is disposed obliquely below the development roller and configured to supply development agent to the development roller, and a regulating member configured to slidably contact a lower side of the development roller and regulate the thickness of the development agent held on the development roller.

In addition, a partition wall that divides the development section from the development agent container is formed with a supply port for supplying the development agent from the development agent container to the development section. Specifically, the supply port is formed to face the regulating member across the supply roller. Thereby, the development agent, which is conveyed from the development agent container to the development section via the development port, is supplied to the supply roller.

SUMMARY

As described above, in the known image forming device, the feed tray is provided so as to protrude forward from the front panel. Therefore, the known image forming device requires a large size in a front-to-rear direction. On the contrary, when configured with a feed tray disposed under a main body, an image forming device is required to be large in the vertical direction (an up-to-down direction), though the image forming device does not have to be large in the front-to-rear direction.

Meanwhile, in the known development unit, the partition wall is formed only with the supply port, which is disposed opposite the regulating member across the supply roller. Therefore, deteriorated development agent scraped off from the development roller might stay in the development section. Hence, when the deteriorated development agent stays in the development section, a lump of deteriorated development agent might be supplied to a photoconductive body via the supply roller and the development roller, and thus it might lead to a lessened quality of image.

Aspects of the present invention are advantageous to provide one or more improved configurations for an image forming device that make it possible to downsize a main body of the image forming device, and one or more improved configurations for a development unit that make it possible to lessen influences of deteriorated development agent on image quality and further improve image quality by enhancing the efficiency of circulation of development agent between a development section and a development agent container.

According to aspects of the present invention, an image forming device is provided, which includes an image forming unit that includes a development agent container configured to accommodate development agent, a development device configured to supply the development agent accommodated in the development agent container to an electrostatic latent image on a photoconductive body and form a development agent image on the photoconductive body, a transfer unit configured to transfer, onto a sheet, the development agent image formed on the photoconductive body, and a fixing unit configured to fix the development agent image on the sheet, a feed tray disposed under the image forming unit, the feed tray being configured such that one or more sheets are placed thereon, a pickup unit configured to pick up and feed a sheet placed on the feed tray toward the image forming unit in a U-turn manner, a first conveying path configured such that the sheet picked up by the pickup unit is conveyed thereon, the first conveying path being tilted to extend downward obliquely from the pickup unit, and a second conveying path formed to be continuous with the first conveying path, the second conveying path being tilted to extend up toward the fixing unit obliquely from a continuous section between the first conveying path and the second conveying path.

According to aspects of the present invention, a development unit attachable to an image forming device is further provided, which development unit includes a development device, a development agent container configured to accommodate development agent, the development agent container being disposed to be adjacent to the development device in a lower position than the development device in an attached state where the development unit is attached to the image forming device, and a partition wall formed between the development device and the development agent container. The development device includes a development roller configured to hold development agent thereon, a supply roller disposed under the development roller in the attached state, the supply roller being configured to supply development agent onto the development roller, a regulator configured to slidably contact the development roller and regulate thickness of the development agent held on the development roller, and a development agent conveyer disposed under the regulator in the attached state, the development agent conveyer being configured to convey development agent in the development device in an axial direction of the supply roller. The partition wall includes a supply port disposed to face the supply roller across the development agent conveyer, the supply port being configured to supply the development agent accommodated in the development agent container into the development device, and a return port disposed under the regulator so as to overlap the regulator when viewed in a vertical direction in the attached state, the return port being configured to return development agent from the development device into the development agent container. The development agent container includes an agitator configured to rotate while sliding in contact with the partition wall and convey the development agent stored in the development agent container to the supply port.

BRIEF DESCRIPTION OF THE ACCOMPANYING DRAWINGS

Figure 4:
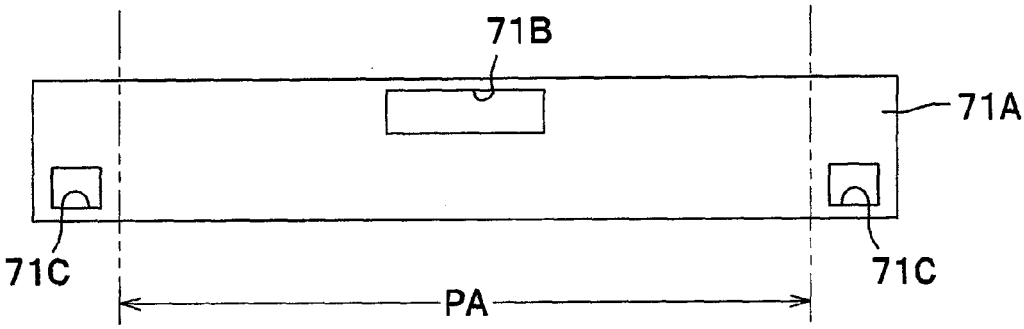

FIG. 4 schematically shows respective locations of a supply port and return ports for the toner cartridge in the embodiment according to one or more aspects of the present invention.

Figure 3:
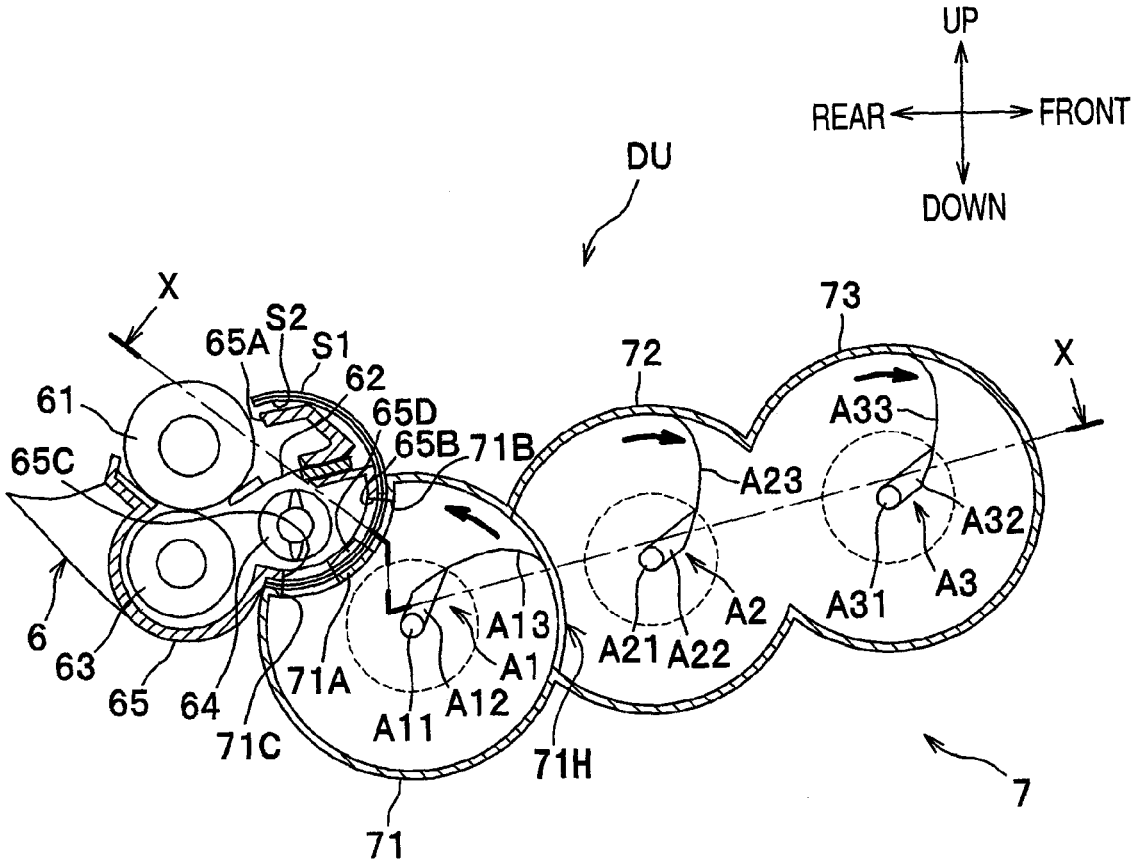
FIG. 3 is a cross-sectional side view showing an internal configuration of the development unit in the embodiment according to one or more aspects of the present invention.
Figure 5:
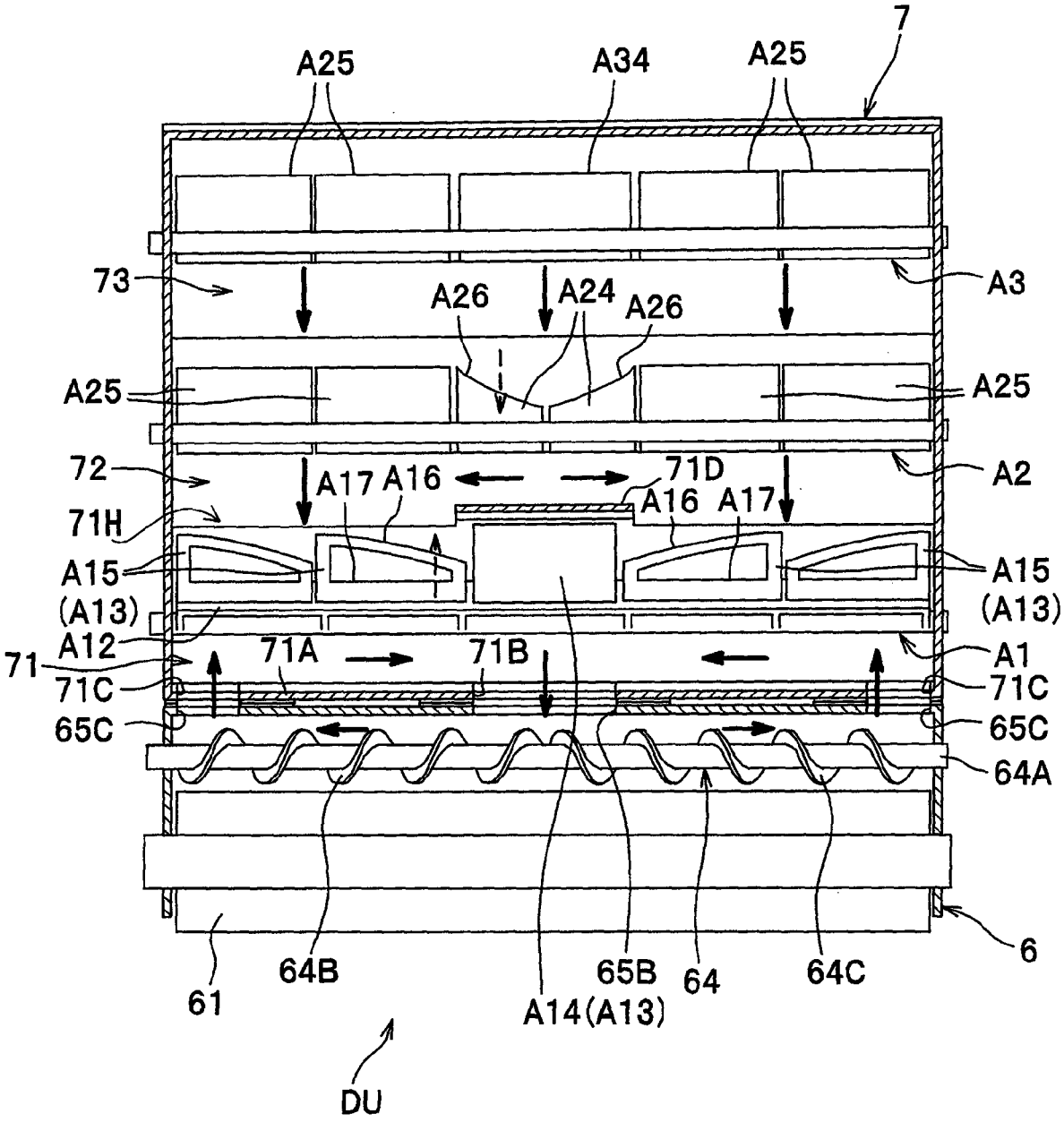
Figure 5:
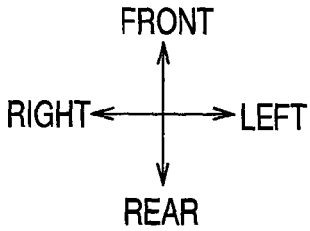

FIG. 5 is a cross-sectional view of the development unit along an X-X line in FIG. 3 in the embodiment according to one or more aspects of the present invention.

Figure 6A:
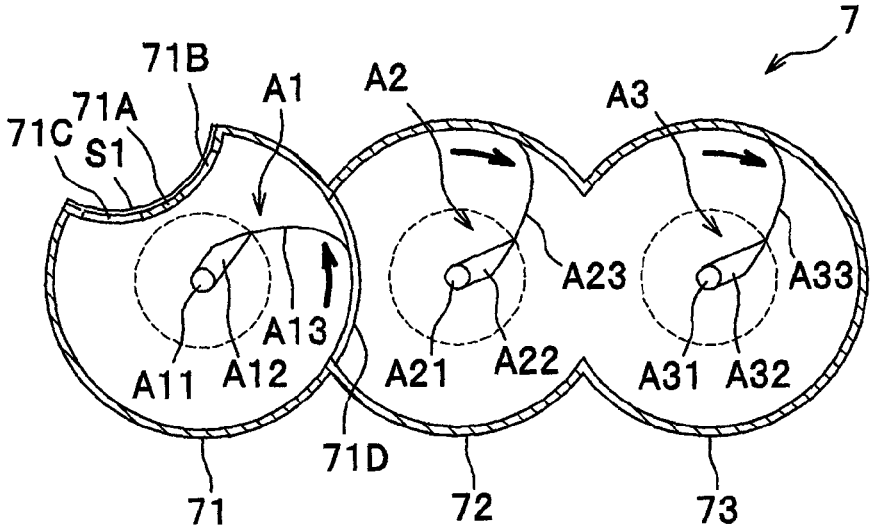

FIG. 6A is a cross-sectional side view showing an internal configuration of the toner cartridge in the embodiment according to one or more aspects of the present invention.

Figure 6B:
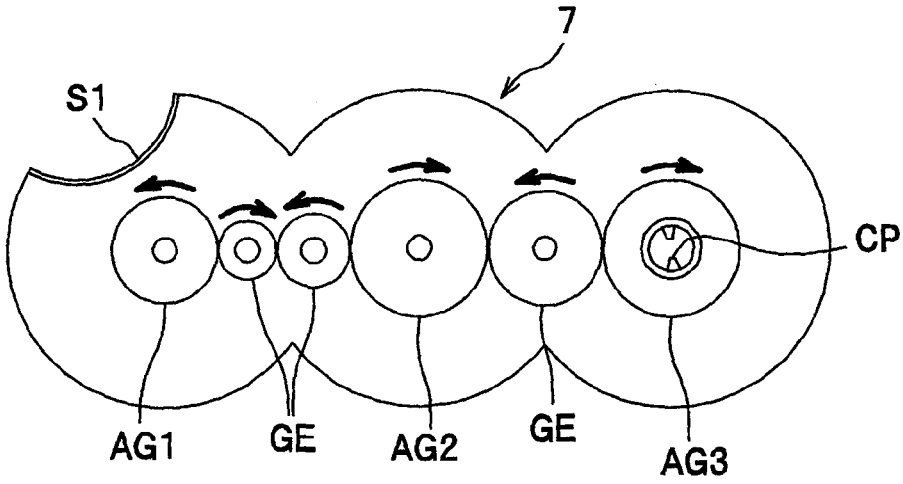

FIG. 6B is a side view of the toner cartridge in the embodiment according to one or more aspects of the present invention.

Figure 7:
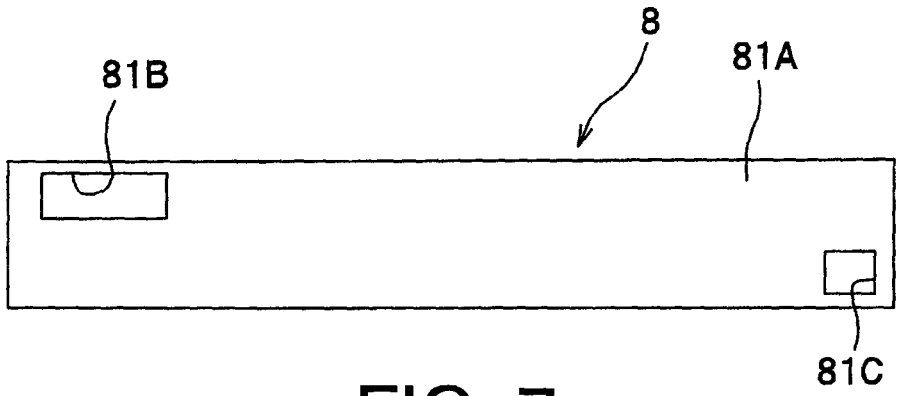

FIG. 7 schematically shows respective locations of a supply port and a return port for a toner cartridge in a modification according to one or more aspects of the present invention.

Figure 8:
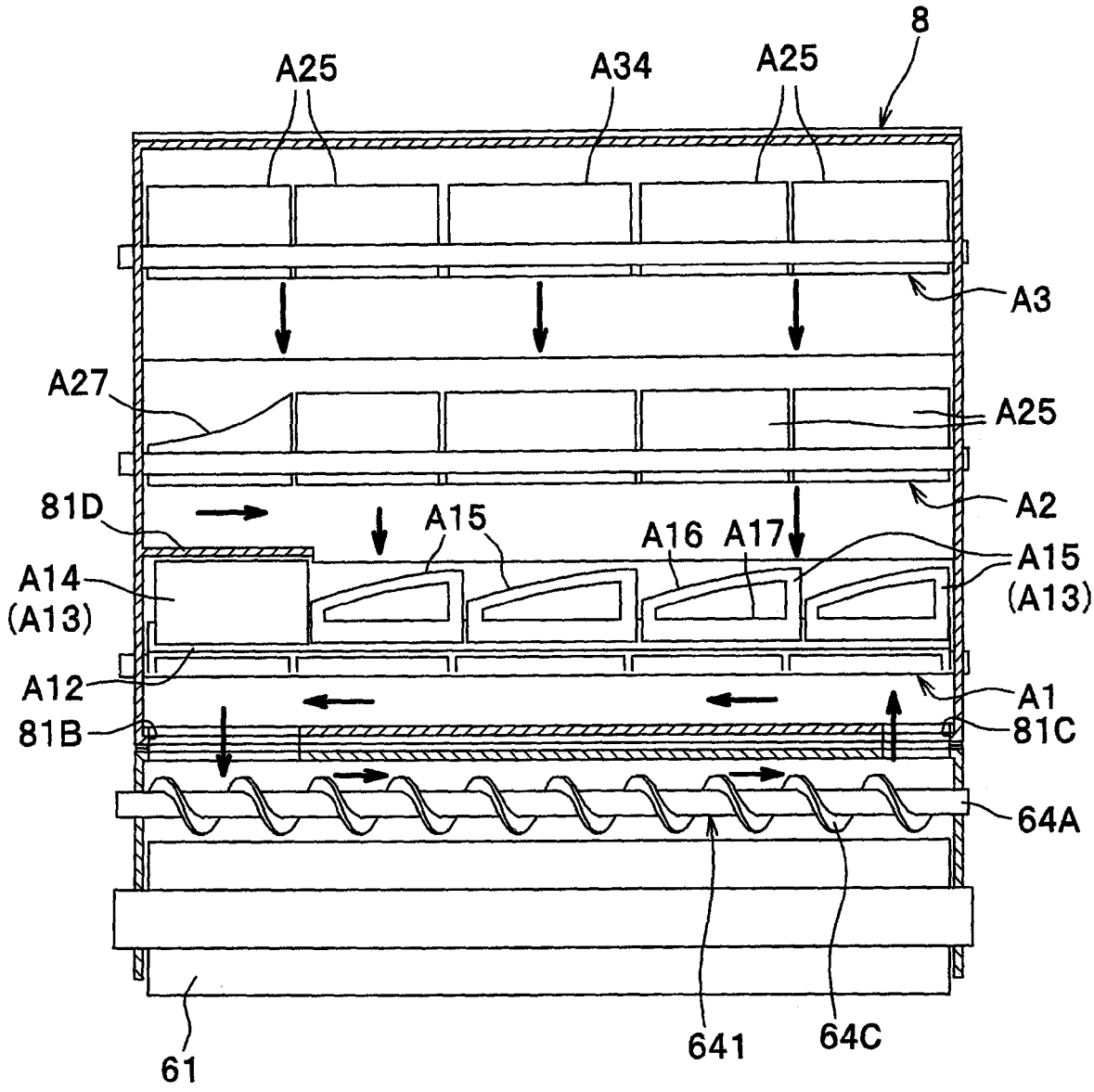
Figure 8:
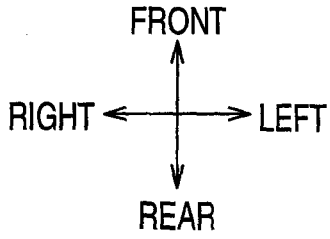

FIG. 8 is a cross-sectional view showing an internal configuration of a development unit in the modification according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect.

Hereinafter, an embodiment according to aspects of the present invention will be described with reference to the accompany drawings. It is noted that when a direction is referred to in the following description, the direction is determined based on the definition thereof as shown in the drawings.

<Overall Configuration of Laser Printer>

Figure 1:
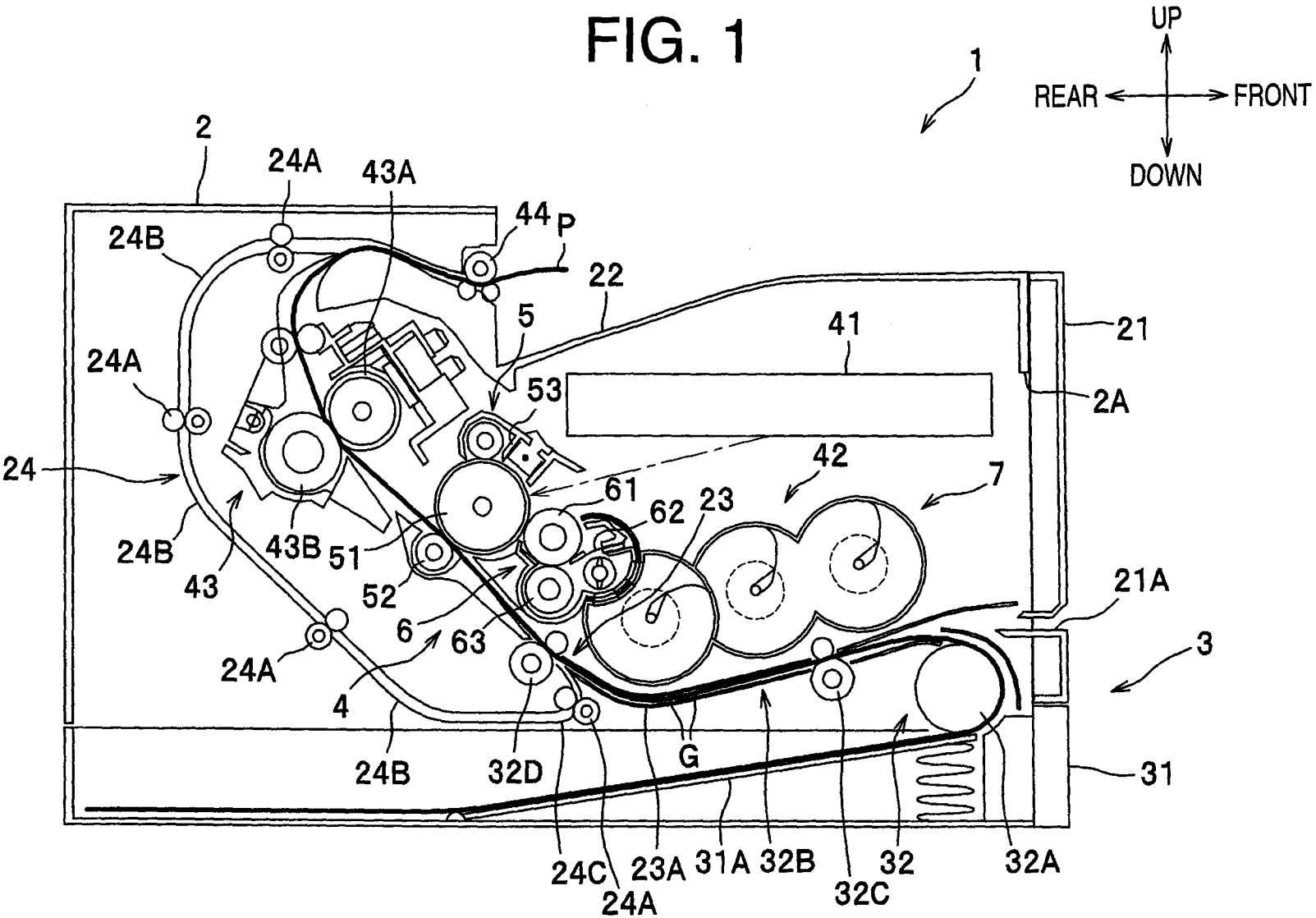
FIG. 1 is a cross-sectional side view showing an internal configuration of a laser printer having a development unit in an embodiment according to one or more aspects of the present invention.

As illustrated in FIG. 1, a laser printer 1 of an embodiment includes a main body 2, a sheet feeder 3, and an image forming unit 4.

The main body 2 is formed in a shape of a hollow case. The main body 2 includes an opening 2A formed at a front wall of the main body, and a front cover 21 configured to swing in a front-to-rear direction so as to open and close the opening 2A (see FIG. 2). The front cover 21 includes a manual sheet inlet 21A formed to face a below-mentioned first conveying path 32B. Additionally, the main body 2 includes a catch tray 22, formed at a top surface thereof, on which a printed sheet P is placed.

The sheet feeder 3 includes a feed tray 31 and a sheet supply mechanism 32.

The feed tray 31 is configured such that sheets P are stacked thereon, and disposed blow the image forming unit 4 (at a lower side of the main body 2). In the feed tray 31, a pressing plate 31A is provided to press a leading end of a sheet P against a below-mentioned pickup roller 32A.

The sheet supply mechanism 32 is disposed at an upper front side relative to the feed tray 31. The sheet supply mechanism 32 includes a pickup roller 32A, a first conveying path 32B, feed rollers 32C, and registration rollers 32D.

The pickup roller 32A is configured to feed a sheet P placed in the feed tray 31 toward the image forming unit 4 in a U-turn manner. The pickup roller 32A is formed with a relatively large diameter so as to feed a sheet P in a preferred U-turn manner.

The first conveying path 32B is configured with a plurality of guides G, and formed to extend obliquely toward a lower rear side from an upper side of the pickup roller 32A. Further, a second conveying path 23 is formed to be continuous with a rear end of the first conveying path 32B.

The second conveying path 23 is configured with guides G and a below-mentioned process cartridge 42. The second conveying path 23 is formed to extend obliquely upward to a below-mentioned fixing unit 43 from a continuous section 23A that is continuous with the first conveying path 32B.

The feed rollers 32C, provided on the first conveying path 32B, are paired rollers configured to feed a sheet P while pinching the sheet P therebetween. More specifically, the feed rollers 32C are disposed in a position that is separated upstream in a sheet feeding direction from the V-shaped continuous section 23A by a distance shorter than the entire length of the sheet P in the sheet feeding direction. Thereby, when the leading end of a sheet P reaches the continuous section 23A, the feed rollers 32C provide a feeding force to the sheet P so as to prevent the leading end of the sheet P from getting stuck with the continuous section 23A.

Further, the feed rollers 32C are disposed away from the manual sheet inlet 21A formed at the front cover 21 by a distance shorter than the entire length of the sheet P in the sheet feeding direction. Thereby, in the middle of a user operation to insert a sheet P into the main body 2 via the manual sheet inlet 21A (i.e., in a state where the sheet P partially protrudes out of the main body 2), the leading end of the sheet P certainly reaches a position between the feed rollers 32C. Hence, the feed rollers 32C can be employed as pickup rollers for manual sheet feeding.

The registration rollers 32D, provided on the second conveying path 23, are paired rollers configured to perform skew correction for a sheet P. Specifically, the registration rollers 32D are disposed in a position that is slightly separated downstream in the sheet feeding direction from the continuous section 23A.

In the sheet feeder 3 configured as above, a sheet P placed in the feed tray 31 is picked up and turned by the pickup roller 32A in a U-turn manner, and thereafter conveyed by the feed rollers 32C to the registration rollers 32D. Then, the sheet P is conveyed to the image forming unit 4 after the skew correction therefor by the registration rollers 32D.

The image forming unit 4 includes a scanning unit 41, a process cartridge 42, and a fixing unit 43.

The scanning unit 41 is configured in a known manner. Specifically, the scanning unit 41 is configured with a laser emitter and a polygon mirror, so as to scan a surface of a photoconductive drum 51 of the process cartridge 42, with a laser beam at a high speed.

The process cartridge 42 includes a drum cartridge 5, a development device 6, and a toner cartridge 7.

The drum cartridge 5 includes the photoconductive drum 51, a transfer roller 52, and a scorotron-type electrification device 53.

The development device 6 includes a development roller 61, a layer thickness regulating blade 62, and a supply roller 63. The development device 6 is detachably attached to the drum cartridge 5.

The toner cartridge 7 is configured to accommodate toner. The toner cartridge 7 is detachably attached to the development device 6. A detailed explanation will be provided later about configurations of the development device 6 and the toner cartridge 7.

The toner cartridge 7 is disposed along the first conveying path 32B. Thereby, there is no useless space between the toner cartridge 7 and the first conveying path 32B, and thus the main body 2 is downsized. In addition, the toner cartridge 7 is disposed to be adjacent to the continuous section 23A. In other words, the toner cartridge 7 is placed beside the second conveying path 23 that rises from the first conveying path 32B. Therefore, since there is no useless space between the toner cartridge 7 and the second conveying path 23, it is possible to further downsize the main body 2.

Figure 2:
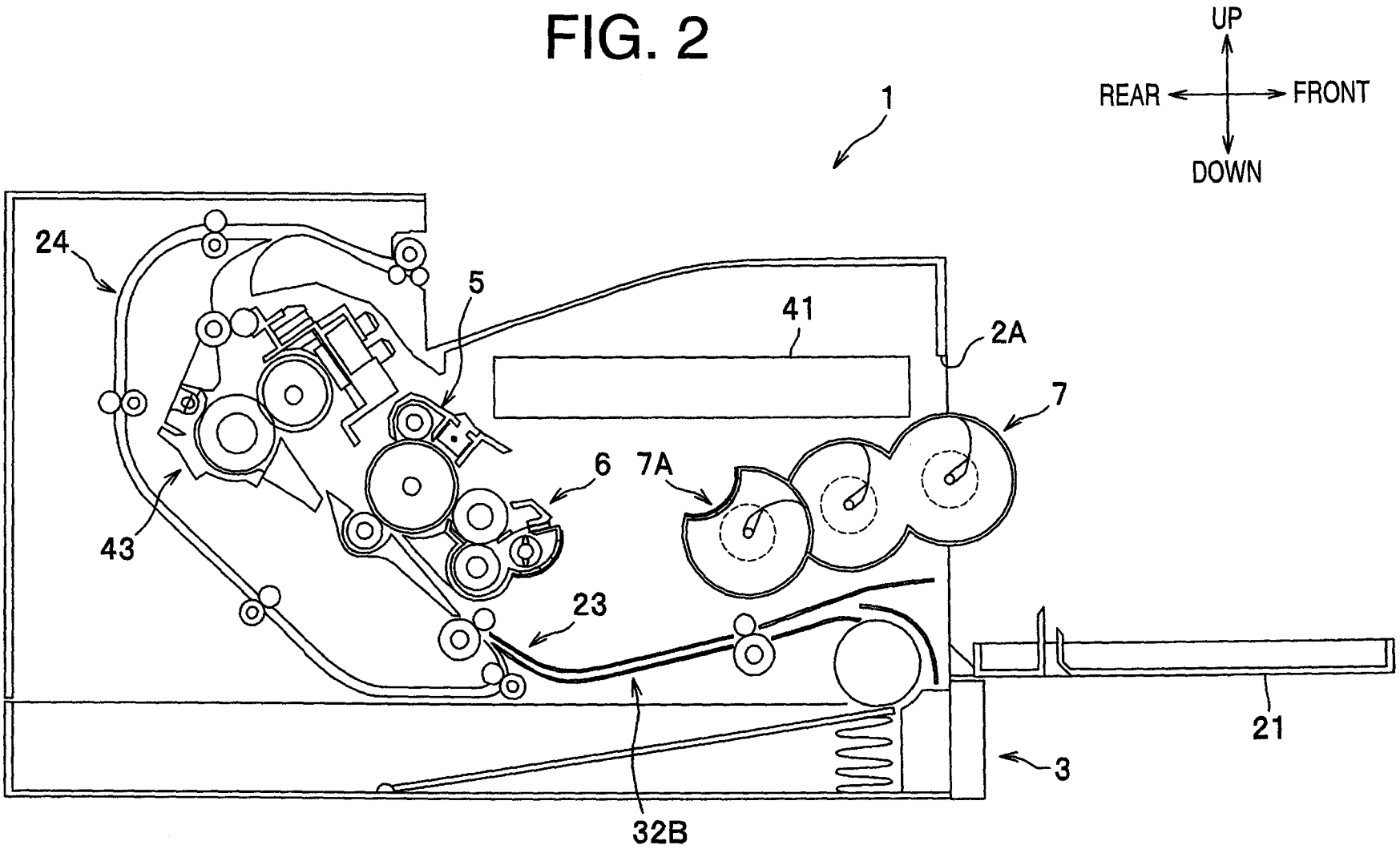
FIG. 2 is a cross-sectional side view showing a state of the laser printer where a front cover is opened such that a toner cartridge is detached in the embodiment according to one or more aspects of the present invention.

In addition, the development device 6 is disposed in a position that is above the toner cartridge 7 and adjacent to the second conveying path 23. Thereby, as depicted in FIG. 2, it is possible to face up a joint section 7A (a surface formed with a below-mentioned supply port 71B) of the toner cartridge 7 with the development device 6. Thus, it is possible to prevent toner from leaking out of the joint section 7A. Further, as the development device 6 is disposed to be adjacent to the second conveying path 23, there is no useless space between the development device 6 and the second conveying path 23. Hence, it is possible to further downsize the main body 2.

It is noted that as shown in FIG. 2, the drum cartridge 5, the development device 6, and the toner cartridge 7 are detachably attached to the main body 2 through the opening 2A that is opened when the front cover 21 is opened.

In the process cartridge 42 configured as above, as illustrated in FIG. 1, the toner, carried from the toner cartridge 7 into the development device 6, is supplied to the development roller 61 via the supply roller 63. At this time, the toner is positively charged between the supply roller 63 and the development roller 61. The toner held on the development roller 61 is carried between the layer thickness regulating blade 62 and the development roller 61 along with rotation of the development roller 61. There, the toner is held on the development roller 61 as a thin layer that has an even thickness regulated by the layer thickness regulating blade 62.

On the other hand, in the drum cartridge 5, the surface of the photoconductive drum 51 is positively charged in an even manner by the scorotron-type electrification device 53. Thereafter, the surface of the photoconductive drum 51 is exposed by the high-speed scanning with the laser beam emitted by the scanning unit 41. Thereby, an electrical potential of the exposed portion is rendered lower so as to form an electrostatic latent image based on image data. Subsequently, when contacting the photoconductive drum 51 along with rotation of the development roller 61, the toner held on the development roller 61 is supplied to the electrostatic latent image formed on the surface of the photoconductive drum 51.

Thereby, the toner is held selectively on the surface of the photoconductive drum 51 and visualized as a toner image formed by reverse development. After that, when a sheet P is fed between the photoconductive drum 51 and the transfer roller 52, the toner image held on the surface of the photoconductive drum 51 is transferred onto the sheet P.

The fixing unit 43 includes a heating roller 43A and a pressing roller 43B. The fixing unit 43 thermally fixes the toner image transferred onto the sheet P while the sheet P is passing between the heating roller 43A and the pressing roller 43B. The sheet P, with the toner image thermally fixed thereon by the fixing unit 43, is ejected onto the catch tray 22 via ejection rollers 44 that is disposed downstream in the sheet feeding direction relative to the fixing unit 43.

Further, behind the fixing unit 43 and the process cartridge 42, a third conveying path 24 is provided for double-side printing. The third conveying path 24 is formed to extend rearward and downward from a downstream side relative to the fixing unit 43 in the sheet feeding direction (specifically, from between the fixing unit 43 and the ejection rollers 44) and to join the second conveying path 23 upstream relative to the registration rollers 32D. Thereby, it is possible to form the conveying path for the double-side printing without making the main body 2 grow in a vertical size, relatively in comparison with such a configuration that the third conveying path 24 joins the first conveying path 32B.

Further, there are plural pairs of backing rollers 24A on the third conveying path 24. Each pair of backing rollers 24A is configured to feed a sheet P while pinching the sheet P between the backing rollers 24A of the pair. More specifically, each of the upstream three of the plural pairs of backing rollers 24A is disposed apart in the sheet feeding direction from an obtusely-bending section 24B of the third conveying path 24 by a distance shorter than the entire length of the sheet P. Thereby, when the leading end of the sheet P reaches the obtusely-bending section 24B, it is possible to feed the sheet P with the upstream three pairs of backing rollers 24A while preventing the leading end of the sheet P from getting stuck with the obtusely-bending section 24A.

Additionally, the most downstream one of the plural pairs of backing rollers 24A is disposed near a saliently-bending section 24C of the third conveying path 24. Thereby, when the leading end of the sheet P reaches the saliently-bending section 24C that is formed such that the sheet P is likely to jam there, the leading end of the sheet P is pinched between the backing rollers 24A of the most downstream pair and forcibly fed. Thus, it is possible to prevent the sheet P from jamming at the saliently-bending section 24C.

According to the above-configured laser printer 1 of the embodiment, the feed tray 31 is disposed under the image forming unit 4. Therefore, it is possible to keep the feed tray 31 from protruding from a side face of the main body 2 and downsize the main body 2 in the horizontal direction. Further, the first conveying path 32B is tilted to extend obliquely toward the lower rear side. Thus, it is possible to locate, at a lower side, major components contained in the main body 2 such as the toner cartridge 7 and to downsize the main body 2 in the vertical direction.

In the embodiment, the registration rollers 32D are disposed on the second conveying path 23. Thereby, a sheet P is not required to, after the skew correction, pass through the continuous section 23A between the first conveying path 32B and the second conveying path 23. Thus, compared with such a configuration that registration rollers are disposed on the first conveying path 32B, it is possible to certainly convey to the image forming unit 4 the sheet P after the skew correction. Further, since the registration rollers 32D are disposed on the second conveying path 23, it is possible to expose, to an opposite side to the first conveying path 32B, a portion of the second conveying path 23 between the registration rollers 32D and the continuous section 23A. Thus, it is possible to easily make the third conveying path 24 for double-side printing join the second conveying path 23.

In the embodiment, the feed rollers 32C are disposed on the first conveying path 32B. Thereby, it is possible to prevent the leading end of the sheet P from getting stuck with the continuous section 23A. Further, it is possible to utilize the feed roller 32C as pickup rollers for feeding a sheet P inserted via the manual sheet inlet 21A.

In the embodiment, the toner cartridge 7 is disposed along the first conveying path 32B. Thereby, since there is no useless space between the toner cartridge 7 and the first conveying path 32B, it is possible to downsize the main body 2.

In the embodiment, the toner cartridge 7 is disposed to be adjacent to the continuous section 23A. Therefore, since there is no useless space between the toner cartridge 7 and the second conveying path 23, it is possible to further downsize the main body 2.

In the embodiment, the development device 6 is disposed above the toner cartridge 7, and thereby, it is possible to face up the joint section 7A (the surface formed with the supply port 71B) of the toner cartridge 7 with the development device 6. Thus, it is possible to prevent the toner from leaking out of the joint section 7A. Further, as the development device 6 is disposed to be adjacent to the second conveying path 23, there is no useless space between the development device 6 and the second conveying path 23. Hence, it is possible to further downsize the main body 2.

In the embodiment, the third conveying path 24 for double-side printing is formed to extend from the downstream side relative to the fixing unit 43 in the sheet feeding direction and join the second conveying path 23 upstream relative to the registration rollers 32D in the sheet feeding direction. Thereby, it is possible to downsize the main body in the vertical direction relatively in comparison with such a configuration that the third conveying path 24 is formed to pass under the continuous section 23A and join the first conveying path 32B.

<Detailed Configurations of Development Device and Toner Cartridge>

Subsequently, detailed explanations will be provided about configurations of the development device 6 and the toner cartridge 7 with reference to FIG. 3. As illustrated in FIG. 3, the development device 6 and the toner cartridge 7 are configured to, when combined, be a development unit DU.

The development device 6 includes an auger 64 as well as the aforementioned development roller 61, layer thickness regulating blade 62, and supply roller 63. The development device 6 further includes a development case 65 configured to accommodate elements such as the development roller 61, the layer thickness regulating blade 62, the supply roller 63, and the auger 64.

At an upper rear side of the development case 65, an opening 65A is formed to face the photoconductive drum 51 (see FIG. 1). At a lower front side of the development case 65, a supply port 65B and two return ports 65C are formed, which correspond to a below-mentioned supply port 71B and two return ports 71C (see FIG. 4) of the toner cartridge 7, respectively. It is noted that in the embodiment, a partition unit between the development device 6 and the toner cartridge 7 includes a partition wall 65D at the development device 6 side and a partition wall 71A at the toner cartridge 7 side.

The development roller 61 is disposed to be exposed out of the opening 65A of the development case 65. In addition, the supply roller is disposed beneath the development roller 61. Further, the layer thickness regulating blade 62 is disposed to be adjacent to and in front of the supply roller 63, and configured to slidably contact a lower front side of the development roller 61.

The auger 64 is disposed under the layer thickness regulating blade 62. As shown in FIG. 5, the auger 64 is configured to carry the toner in an axial direction of the development roller 61 (or the supply roller 63), more specifically, from the center toward both sides of the auger 64 in the left-to-right direction. Thereby, deteriorated toner scraped off by the layer thickness regulating blade 62 is dispersed in a preferable fashion in the left-to-right direction by the auger 64.

Specifically, the auger 64 includes a rotational shaft 64A, and a first corkscrew blade 64B and a second corkscrew blade 64C that are formed to be wound around the rotational shaft 64A in a corkscrew shape.

The first corkscrew blade 64B and the second corkscrew blade 64C are disposed at the right side and the left side, respectively, with respect to the center in the axial direction of the rotational shaft 64A. Further, the first corkscrew blade 64B and the second corkscrew blade 64C have respective different corkscrew orientations. Specifically, the first corkscrew blade 64B is configured to carry the toner rightward while the second corkscrew blade 64C is configured to carry the toner leftward.

As depicted in FIG. 3, the toner cartridge 7 includes a first container 71, a second container 72, and a third container 73 that are configured to accommodate toner.

When the toner cartridge 7 is attached to the development device 6 (specifically, when the development unit DU is attached to the main body 2), the first container 71 is disposed to be adjacent to and obliquely in lower front of the development device 6. The first container 71 is formed in shape of a hollow cylinder. Further, a partition wall 71A, which is one of walls forming the first container 71 and adjacent to the development device 6, is formed to be recessed toward the inside of the first container 71.

Specifically, the partition wall 71A is formed with an arc-shaped cross-section that includes a section extending substantially in the horizontal direction and a section extending substantially in the vertical direction. Additionally, the partition wall 71A is formed with a supply port 71B for supplying the toner from the toner cartridge 7 to the development device 6 and two return ports 71C (see FIG. 4) for returning the toner from the development device 6 to the toner cartridge 7.

As illustrated in FIG. 4, the supply port 71B is formed in the center of an upper half portion of the partition wall 71A in the left-to-right direction. Further, each return port 71C is formed at one of both sides of a lower half portion of the partition wall 71A in the left-to-right direction, specifically, in one of both areas, outside a printing area PA, of the lower half portion of the partition wall 71A. Namely, each return port 71C is formed in a position shifted relative to the supply port 71B in both the left-to-right direction (an axial direction of the supply roller 63) and the up-to-down direction (the vertical direction).

Thus, since each return port 71C is disposed in a position shifted relative to the supply port 71B in the axial direction of the supply roller 63, it is possible to prevent the toner supplied into the development device 6 via the supply port 71B from immediately returning into the toner cartridge 7 via the return ports 71C. Further, it would be difficult to form the flow of toner inside the development device 6 if the return ports 71C and the supply port 71B were disposed in the same position in the axial direction of the supply roller 63. However, in the embodiment, the return ports 71C and the supply port 71B are mutually shifted in the axial direction of the supply roller 63. Thus, as shown in FIG. 5, it is possible to form the flow of toner from the supply port 71B to the return ports 71C.

Further, as depicted in FIG. 3, the supply port 71B is formed at a section, of the partition wall 71A, which extends substantially in the vertical direction, and opened in a substantially horizontal direction. It is noted here that "the substantially horizontal direction" is defined to include the horizontal direction and directions slightly tilted relative to the horizontal direction.

Since the supply port 71B is horizontally opened as described above, it is possible for a below-mentioned first agitator A1 to efficiently carry the toner into the development device 6 via the supply port 71B. Even granting that the supply port 71B is vertically opened, the toner might return into the toner cartridge 7 via the supply port 71B immediately after being carried up by the first agitator A1 into the development device 6 via the supply port 71B. Thus, in the embodiment, it is possible to prevent the toner from turning back into the toner cartridge 7 via the supply port 71B, which is horizontally opened.

Further, since the supply port 71B is horizontally opened, the top surface level of the toner in the development device 6 is kept constant so as to stay near a lower end of the supply port 71B, i.e., so as not to be excessively higher than or lower than the lower end of the supply port 71B. Thereby, it is possible to reduce a pressure which the toner applies to sliding-contact interfaces between the development roller 61 and the layer thickness regulating blade 62 or between the development roller 61 and various seal members (not shown) slidably contacting the development roller 61. Hence, it is possible to prevent the toner from excessively leaking from the sliding-contact interfaces.

Further, each return port 71C is formed at a section, of the partition wall 71A, which extends substantially in the horizontal direction, and opened in a substantially vertical direction. It is noted here that "the substantially vertical direction" is defined to include the vertical direction and directions slightly tilted relative to the vertical direction.

Since each return port 71C is vertically opened as described above, it is possible to efficiently return the toner from the development device 6 into the toner cartridge 7. Thereby, it is possible to enhance toner circulation and reduce the open area of each return port 71C. Therefore, even though the return ports 71C are formed outside the printing area PA (see FIG. 4), it is possible to prevent the development unit DU from becoming larger.

The printing area PA represents an area within the maximum width (i.e., the maximum length in a direction perpendicular to the sheet feeding direction) of a toner image transferred onto a sheet P. In the embodiment, since each return port 71C is disposed outside the printing area PA, it is possible to avoid such an undesired situation that toner is stored in both sides (outside the printing area PA) in the left-to-right direction in the development device 6. Further, toner is likely to be in short supply in a region, in the development device 6, which faces each return port 71C. However, since the region is located outside the printing area PA, the short supply of toner in the region does not exert any undesired influence on printing.

As shown in FIG. 3, when the toner cartridge 7 is attached to the development device 6 (specifically, when the development unit DU is attached to the main body 2), the supply port 71B is disposed to face the supply roller 63 across the auger 64. Therefore, it is possible to disperse toner, which is newly supplied into the development device 6 via the supply port 71B, in the left-to-right direction with the auger 64. Thus, it is possible to mix the newly supplied toner with deteriorated toner.

Further, in the state where the toner cartridge 7 is attached to the development device 6, the return port 71C is disposed under the layer thickness regulating blade 62 so as to overlap the layer thickness regulating blade 62 when viewed in the up-to-down direction. Hence, the deteriorated toner scraped off by the layer thickness regulating blade 62 is easily discharged into the toner cartridge 7 via the return port 71C.

As shown in FIG. 6A, the first container 71 includes a first shutter S1 that is disposed outside the partition wall 71A and configured to open and close the supply port 71B and the return port 71C when moved along a circumferential direction of the partition wall 71A. The first shutter S1 includes a thin metal plate formed in shape of an arc along the partition wall 71A.

Further, as illustrated in FIG. 3, the partition wall 65D on the side of the development device 6 is provided with a second shutter S2 formed in shape of an arc along the partition wall 65D. The first shutter S1 and the second shutter S2 are configured to rotate integrally in engagement with each other. Here, there is a problem that the toner might leak from between the first shutter S1 and the partition wall 71A and between the second shutter S2 and the partition wall 65D. Nevertheless, in the embodiment, it is possible to reduce the opening area of each return port 71C which is opened in the up-to-down direction. Thus, it is possible to decrease the amount of such leaking toner. Further, in order to avoid the toner leak problem, sponges formed in shape surrounding the return ports 71C may be disposed respectively between the first shutter S1 and the partition wall 71A and between the second shutter S2 and the partition wall 65D. In this case as well, owing to the reduced opening area of each return port 71C, it is possible to reduce the sizes of the sponges for surrounding the return ports 71C. Thus, it is possible to reduce sliding resistances generated along with opening/closing operations for the first and second shutters S1 and S2.

Additionally, in the first container 71, a first agitator A1 is provided, which is configured to rotate (counterclockwise in the relevant drawings) while contacting the partition wall 71A in a sliding manner. The first agitator A1 includes a rotational shaft A11 rotatably supported by left and right walls of the toner cartridge 7 (the first container 71), a supporter A12 that extends radially from the rotational shaft A11, and an agitator blade A13 supported by the supporter A12.

As depicted in FIG. 5, the agitator blade A13 includes a first film A14 disposed in the center of the agitator blade A13 in the left-to-right direction, and two second films A15 on each of the both sides of the first film A14 in the left-to-right direction. In other words, the agitator blade A13 is formed as a whole with a width that allows the agitator blade A13 to contact the supply port 71B and the return ports 71C in a sliding manner.

The first film A14 is an elastically-deformable rectangular film that has the same width as that of the supply port 71B in the left-to-right direction. Further, the first film A14 is configured to slidably contact a facing wall 71D (see FIG. 6A) in a bending state, which facing wall 71D is disposed between the first container 71 and the second container 72 and formed with an arc-shaped cross-section when viewed in the left-to-right direction.

The facing wall 71D is configured to seal the center of a wide opening that establishes communication between the first container 71 and the second container 72. Specifically, the facing wall 71D is disposed to face the supply port 71B and formed with a width longer than the width of the first film A14. Thereby, the toner conveyed by the first film A14 is carried upward while held between the first film A14 and the facing wall 71D, and then carried toward the supply port 71B in a preferred manner.

Each second film A15 is an elastically-deformable film. Further, each second film A15 has a sliding-contact section A16 configured to contact an inner surface of the first container 71. The sliding-contact section A16 is formed to be more tilted backward in a rotational direction (i.e., a direction indicated by a dashed-line arrow in FIG. 5) as being closer to the first film A14. Specifically, each second film A15 is configured such that the shape thereof and orientation(s) in which the second film A15 is supported by the supporter A12 are appropriately set. Thereby, an inside portion of the sliding-contact section A16 in the left-to-right direction contacts the inner surface of the first container 71 in a sliding manner behind an outside portion of the sliding-contact section A16 in the left-to-right direction.

Thus, the inside portion of the sliding-contact section A16 in the left-to-right direction contacts the inner surface of the first container 71 in a sliding manner behind the outside portion of the sliding-contact section A16 in the left-to-right direction. Thereby, the toner is conveyed from the return ports 71C at the outsides in the left-to-right direction to the supply port 71B in the center in the left-to-right direction. Further, each second film A15 is formed with a center hole A17. Thereby, it is possible to prevent the toner returned into the first container 71 via the return ports 71C from being excessively pushed back from the first container 71 to the second container 72.

In other words, by adequately setting the size of the center hole A17, it is possible to push back an appropriate amount of toner stored in the first container 71 into the second container 72. Thereby, it is possible to convey a part of the deteriorated toner returned from the development device 6 into the toner cartridge 7 and disperse the deteriorated toner between the first container and the second container in a preferable fashion.

As shown in FIG. 3, when the toner cartridge 7 is attached to the development device 6 (specifically, the development unit DU is attached to the main body 2), the second container 72 is disposed to be adjacent to and obliquely in upper front of the first container 71. Thereby, it is possible to convey the toner from the second container 72 to the first container 71 using the gravity in a preferable manner.

The second container 72 is formed in shape of a hollow cylinder. A rear portion of the second container 72 other than the facing wall 71D communicates with the first container 71. Further, a front portion of the second container 72, substantially as a whole, communicates with the third container 73. In addition, a second agitator A2 is provided in the second container 72. The second agitator A2 is configured to rotate in the opposite direction (clockwise in the relevant drawings) to the rotational direction of the first agitator A1 and convey to the first container 71 toner staying on the bottom of the second container 72. In other words, the first agitator A1 and the second agitator A2 are configured to rotate in their respective different rotational directions, from downside to upside relative to a communication hole 71H formed between the first container 71 and the second container 72. The second agitator A2 includes a rotational shaft A21 and a supporter A22 that are configured substantially in the same manner as the first agitator A1, and an agitator blade A23 configured in a different manner from the first agitator A1.

As illustrated in FIG. 5, the agitator blade A23 includes a pair of elastically-deformable third films A24 that are disposed in the center of the agitator blade A23 in the left-to-right direction, and elastically-deformable rectangle fourth films A25 two of which are disposed at each of both sides relative to the third films A24 in the left-to-right direction.

The third films A24 are arranged side by side in the left-to-right direction within the width of the facing wall 71D. Each third film A24 has a sliding-contact section A26 configured to contact an inner surface of the second container 72. The sliding-contact section A26 is formed to be more tilted frontward in a rotational direction (i.e., a direction indicated by a dashed-line arrow in FIG. 5) as being closer to an adjacent third film A24. Specifically, each third film A24 is configured such that the shape thereof and orientation(s) in which the third film A24 is supported by the supporter A22 are appropriately set. Thereby, an outside portion of the sliding-contact section A26 in the left-to-right direction contacts the inner surface of the second container 72 in a sliding manner behind an inside portion of the sliding-contact section A26 in the left-to-right directions.

Thus, the outside portion of the sliding-contact section A24 in the left-to-right direction contacts the inner surface of the second container 72 in a sliding manner behind the inside portion of the sliding-contact section A24 in the left-to-right direction. Thereby, the toner is conveyed from the center to the outsides of the agitator blade A23 in the left-to-right direction. In other words, each third film A24 serves as a blade for conveying the toner from the center to the outsides of the agitator blade A23 in the left-to-right direction. Hence, the toner is conveyed by the third films A24 toward the fourth films A25 while being kept away from the facing wall 71D disposed behind the third films A24, and then conveyed by the fourth films A25 to the first container 71.

As depicted in FIG. 3, when the toner cartridge 7 is attached to the development device 6 (specifically, when the development unit DU is attached to the main body 2), the third container 73 is disposed to be adjacent to and obliquely in upper front of the second container 72. Thereby, it is possible to convey the toner from the third container 73 to the second container 72 using the gravity in a preferable manner.

The third container 73 is formed in shape of a hollow cylinder. A rear portion of the third container 73, substantially as a whole, communicates with the second container 72. In addition, a third agitator A3 is provided in the second container 72. The third agitator A3 is configured to rotate in the opposite direction (clockwise in the relevant drawings) to the rotational direction of the first agitator A1 and convey to the second container 72 toner staying on the bottom of the third container 73. The third agitator A3 includes a rotational shaft A31 and a supporter A32 that are configured substantially in the same manner as the second agitator A2, and an agitator blade A33 configured in a slightly different manner from the second agitator A2.

As shown in FIG. 5, the agitator blade A33 has an elastically-deformable rectangular fifth film A34 disposed in the center of the agitator blade A33 in the left-to-right direction. Further, the agitator blade A33 has additional films configured in the same manner as the fourth films A25 of the second agitator A2 such that two of the additional films are dispose at each of both sides relative to the fifth film A34 in the left-to-right direction (the additional films will as well be referred to as the fourth films A25). Thereby, it is possible to concurrently convey all the toner in the third container 73 into the second container 72.

As shown in FIG. 6B, a first agitator gear AG1 is provided to an end of the first agitator A1 in an integral and concentric manner. Additionally, a second agitator gear AG2 is provided to an end of the second agitator A2 in an integral and concentric manner. Further, a third agitator gear AG3 is provided to an end of the third agitator A3 in an integral and concentric manner. There are two gears GE provided between the first agitator gear AG1 and the second agitator gear AG2. There is another gear GE between the second agitator gear AG2 and the third agitator gear AG3.

Thereby, when a driving force is transmitted by a driving source (not shown) to a coupling section CP formed at a rotational center axis of the third agitator gear AG3, the third agitator gear AG3 and the second agitator gear AG2 rotate in the same direction. Meanwhile, at that time, the first agitator gear AG1 rotates in the opposite direction to the rotational direction of the second agitator gear AG2 and the third agitator gear AG3. It is noted that the gears AG1, AG2, AG3, and GE are covered with a gear case (not shown) that is detachably attached to a side wall of the toner cartridge 7.

According to the embodiment set forth above, the auger 64 and the return ports 71C are disposed below the layer thickness regulating blade 62. Therefore, the deteriorated toner scraped off by the layer thickness regulating blade 62 is conveyed by the auger 64 in the left-to-right direction, agitated in the development device 6, and discharged into the toner cartridge 7 via the return ports 71C. Thus, since the deteriorated toner is dispersed in the development unit DU such that influences thereof on image quality are weakened, it is possible to enhance the image quality. Further, the supply port 71B is disposed to face the supply roller 63 across the auger 64. Therefore, the toner newly supplied into the development device 6 via the supply port 71B is dispersed in the left-to-right direction by the auger 64, and mixed with the deteriorated toner. Thus, it is possible to supply toner of preferable quality to the supply roller 63 and improve the image quality.

The supply port 71B is formed to be open horizontally to the partition wall 71A which is formed to be recessed toward the inside of the toner cartridge 7. Therefore, it is possible for the first agitator A1 to efficiently convey the toner into the development device 6 via the supply port 71B. Further, since the supply port 71B is horizontally opened, the top surface level of the toner supplied into the development device 6 is kept constant. Hence, it is possible to prevent the toner from excessively leaking, e.g., from a sliding-contact interface between development roller 61 and the layer thickness regulating blade 62.

Since the return ports 71C are vertically opened, it is possible to efficiently return the toner from the development device 6 to the toner cartridge 7 and enhance circulation of the toner. Further, since the return ports 71C are vertically opened so as to efficiently return the toner, it is possible to reduce the open area of each return port 71C and form the return ports 71C outside the printing area PA without having to increase the size of the development unit DU.

Since the supply port 71B and the return ports 71C are located in respective different positions in the left-to-right direction, it is possible to prevent the toner supplied into the development device 6 via the supply port 71B from immediately returning into the toner cartridge 7 via the return ports 71C.

The first shutter S1 and the second shutter S2 are provided movably along the circumferential directions of the arc-shaped partition walls 71A and 65D, respectively. For instance, compared with such a configuration that one or more shutters are provided movably in the left-to-right direction (i.e., the axial direction of the arc-shaped circumferences of the partition walls 71A and 65D), it is possible for the first and second shutters S1 and S2 to move in a relatively smooth manner. Further, compared with such a configuration that one or more flat shutters are provided movably along flat partition walls, it is possible to avoid an undesirable situation that the shutters are so tilted as to be unmovable.

Since the second container 72 and the third container 73 are additionally provided to be adjacent to the first container 71, it is possible to increase the capacity for accommodating toner. Further, as the agitators A1 to A3 are provided respectively in the containers 71 to 73, the toner is conveyed in the toner cartridge 7 in a preferable manner.

The facing wall 71D is disposed between the first container 71 and the second container 72 so as to face the supply port 71B. Further, the facing wall 71D is configured such that the first agitator A1 slides in contact therewith. Therefore, it is possible to hold the toner between the first agitator A1 and the facing wall 71D and convey the toner in a preferable fashion to the supply port 71B which is formed at an upper side of the first container 71.

The first agitator A1 and the second agitator A2 are configured to rotate from downside to upside relative to the communication hole 71H formed between the first container 71 and the second container 72. Hence, the toner stored in the first container 71 is returned into the second container 72 by the first agitator A1 Further, the toner stored in the second container 72 is pushed out into the first container 71 by the second agitator A2. Therefore, it is possible to enhance the efficiency of toner circulation between the first container 71 and the second container 72 and prevent the toner from being accumulated in the toner cartridge 7.

Hereinabove, the embodiment according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications are possible.

In the aforementioned embodiment, the development unit DU is configured with separate components, the development device 6 and the toner cartridge 7. However, the development unit DU may be configured with a single component into which the development device 6 and the toner cartridge 7 are integrated. It is noted that when the development unit DU is configured with a single component, the development unit DU may have a single partition wall between a development section and a toner container section and no shutter.

It is noted that the sheet P may include an OHP transparent sheet as well as a heavy paper, a thin paper, and a postcard. Further, instead of the photoconductive drum 51 adopted in the aforementioned embodiment, for instance, a belt-shaped photoconductive body may be employed.

In the aforementioned embodiment, the transfer roller 52 is adopted. However, an element corresponding to the transfer roller 52 may not necessarily be roller-shaped.

Further, instead of the heating roller 43A adopted in the aforementioned embodiment, a cylinder-shaped fixing film slidably supported by a guide may be applied.

Further, instead of the feed tray 31 adopted in the aforementioned embodiment that is configured to be drawn out of the main body 2, for instance, a recessed portion formed integrally with the main body 2 may be employed.

Further, instead of the pickup roller 32A adopted in the aforementioned embodiment, a pickup mechanism that includes a curved guide for feeding a sheet in a U-turn manner and a plurality of rollers disposed along the guide may be applied.

In the aforementioned embodiment, the partition wall 65D of the development device 6 is provided with the supply port 65B and the return ports 65C. Further, the partition wall 71A of the toner cartridge 7 is provided with the supply port 71B and the return ports 71C. However, a single large opening may be provided to one of the partition walls 65D and 71A, which single large opening communicates with both the supply port and the return ports of the other partition wall. Namely, for instance, a portion, corresponding to the partition wall 71A of the toner cartridge 7 in the aforementioned embodiment, may be configured as an opening. Further, in this case, the partition wall 65D of the development device 6 may be configured to seal the opening of the toner cartridge 7. In other words, the partition wall 65D of the development device 6 may be formed to constitute a portion (corresponding to the partition wall 71A) of the toner cartridge 7.

In addition, the positions and the number of the supply port(s) and the return port(s) may be set as needed. For example, as shown in FIG. 7, a single wide supply port 91B may be formed at one of both ends in the left-to-right direction of a partition wall 81A of a toner cartridge 8, and a single return port 81C may be formed in a position lower than the supply port 81B, at the other end.

In this case, as illustrated in FIG. 8, an auger may be adopted that includes one kind of auger (i.e., the second corkscrew blade 64C) to convey the toner from one end to another in the left-to-right direction. Further, in this case, the positions of a facing wall 81D, the first film A14, and the second film A15 may be changed appropriately depending on the position of the supply port 81B. Additionally, the shape of the third film A27 disposed in front of the facing wall 81D may be changed so as to convey the toner toward one side.

In the aforementioned embodiment, the first agitator A1 is employed that includes the supporter A12 and the agitator blade A13. However, an agitator may be employed that has no supporter.

In the aforementioned embodiment, the layer thickness regulating blade 62 is employed that is configured with a metal plate and a rubber attached to a distal end of the metal plate. However, a layer thickness regulating blade may be employed that includes a metal plate with no rubber attached thereto.

In the aforementioned embodiment, aspects of the present invention are applied to the laser printer 1. Nevertheless, for instance, aspects of the present invention may be applied to other image forming devices such as a copy machine and a multi-function peripheral.

What is claimed is:

1. An image forming device comprising:

a main body comprising a bottom portion;

an image forming unit that comprises:

a photoconductive body;

a development agent container configured to accommodate development agent;

a development device configured to supply the photoconductive body with development agent;

a transfer unit configured to transfer, onto a sheet, a development agent image formed on the photoconductive body; and a fixing unit configured to fix the development agent image on the sheet;

a feed tray disposed under the image forming unit and configured to hold a sheet;

a pickup roller configured to pick up and feed a sheet held in the feed tray toward the image forming unit;

a first conveying guide configured to guide the sheet picked up by the pickup roller, wherein the first conveying guide extends from a first position at an upper portion of the pickup roller to a second position; and a second conveying guide configured to receive and guide the sheet from the first conveying guide, wherein the second conveying guide extends from the second position to a third position at the fixing unit through a nipping point disposed between the photoconductive body and the transfer unit, wherein the development agent container is disposed above the second position, wherein a first distance between the first position and the bottom portion of the main body is longer than a second distance between the second position and the bottom portion of the main body, wherein a third distance between the third position and the bottom portion of the main body is longer than the second distance, wherein a fourth distance between the nipping point and the bottom portion of the main body is longer than the second distance, and wherein the fourth distance is shorter than the third distance.

2. The image forming device according to claim 1, further comprising a registration roller disposed between the second position and the third position, wherein the registration roller is configured to perform skew correction for a sheet guided onto the second conveying guide.

3. The image forming device according to claim 1, further comprising a feed roller disposed between the first position and the second position, wherein the feed roller is configured to feed a sheet guided by the first conveying guide.

4. The image forming device according to claim 1, wherein the development agent container extends along the first conveying guide, and wherein a fifth distance between a lower end of the development agent container and the bottom portion of the main body is less than the first distance between the first position and the bottom portion of the main body.

5. The image forming device according to claim 4, wherein the lower end of the development agent container is disposed to be adjacent to the second position between the first conveying guide and the second conveying guide.

6. The image forming device according to claim 5, wherein the development device is disposed above the development agent container and adjacent to the second conveying guide.

7. The image forming device according to claim 2, further comprising a third conveying guide for double-side printing, wherein the third conveying guide is configured to extend from a downstream side relative to the fixing unit in a sheet feeding direction in which a sheet is fed, and to join the second conveying guide upstream relative to the registration roller in the sheet feeding direction.

8. A development unit comprising:

a development device; and a development agent container configured to accommodate development agent, wherein the development agent container is disposed adjacent to the development device in a lower position than the development device when the development unit is attached to an image forming device, the developing agent container comprising a partition wall disposed adjacent to the development device, the partition wall comprising:

a supply port configured to supply development agent accommodated in the development agent container into the development device; and a return port configured to return development agent from the development device into the development agent container, wherein the supply port and the return port are disposed to be offset from each other, wherein the development agent container comprises an agitator configured to rotate while sliding in contact with the partition wall and convey development agent accommodated in the development agent container to the supply port, wherein the development device comprises:

a development roller configured to hold development agent thereon;

a supply roller disposed under the development roller when the development unit is attached to the image forming device, wherein the supply roller is configured to supply development agent onto the development roller;

a regulator configured to slidably contact the development roller and regulate thickness of the development agent held on the development roller; and a development agent conveyer configured to convey development agent in the development device in an axial direction of the supply roller, and wherein, when the development unit is attached to the image forming device, the development agent conveyer is disposed under the regulator such that the supply roller and the supply port of the partition wall are disposed on opposite sides of the development agent conveyer in a horizontal direction and the regulator and the return port of the partition wall are disposed on opposite sides of the development agent conveyer in a vertical direction.

9. The development unit according to claim 8, wherein the partition wall is formed to be recessed toward an inside of the development agent container when viewed in a rotational axis direction of the agitator, and wherein the supply port faces the horizontal direction when the development unit is attached to the image forming device.

10. The development unit according to claim 9, wherein the return port is opened in the vertical direction when the development unit is attached to the image forming device.

11. The development unit according to claim 8, wherein the supply port and the return port are disposed at respective different locations in the axial direction of the supply roller.

12. The development unit according to claim 8, wherein the development agent container is configured to be detachably attached to the development device.

13. The development unit according to claim 12, wherein the partition wall comprises an arc portion, and wherein the development unit further comprises a shutter configured to move along a circumferential direction of the partition wall between a closed position, in which the supply port and the return port are closed, and an open position in which the supply port and the return port are open.

14. The development unit according to claim 8, wherein the development agent container comprises:

a container wall which comprises a first chamber; and a second chamber, wherein the first chamber is disposed between the development device and the second chamber.

15. The development unit according to claim 14, wherein the agitator comprises a first agitator provided in the first chamber and a second agitator provided in the second chamber, wherein the container wall has a communication hole, and wherein the first agitator and the second agitator are configured to rotate in respective different rotational directions, from downside to upside relative to the communication hole.

16. A development unit, comprising:

a development device comprising:

a development roller configured to hold development agent;

a supply roller disposed under the development roller and configured to supply development agent onto the development roller;

a regulator configured to regulate a thickness of development agent held on the development roller; and a development agent conveyer configured to convey development agent in an axial direction of the supply roller, a development agent container configured to accommodate development agent, wherein the development agent container is disposed adjacent to the development device at a lower position than the development device, and the development agent container comprising:

a partition wall having a supply port configured to supply development agent from the development agent container to the developing device and a return port configured to return the development agent from the developing device to the development agent container; and an agitator configured to convey development agent accommodated in the development agent container to the supply port, and wherein, when the development unit is attached to the image forming device, the development agent conveyer is disposed under the regulator such that the supply roller and the supply port of the partition wall are disposed on opposite sides of the development agent conveyer in a horizontal direction and the regulator and the return port of the partition wall are disposed on opposite sides of the development agent conveyer in a vertical direction.

17. The development unit according to claim 16, wherein the development agent conveyer is disposed so as to partially overlap both the supply roller and the supply port of the partition wall in the horizontal direction, and wherein the development agent conveyer is disposed so as to partially overlap both the regulator and the return port of the partition wall in the vertical direction.

18. The development unit according to claim 16, wherein the supply port faces the horizontal direction and the return port faces the vertical direction.

* * * * *